US010787793B2

(12) United States Patent
Hills et al.

(10) Patent No.: US 10,787,793 B2
(45) Date of Patent: Sep. 29, 2020

(54) TAGGED EXCAVATION ELEMENT

(71) Applicant: The South African Nuclear Energy Corporation (SOC) Ltd., Brits Magisterial District (ZA)

(72) Inventors: Andries Elias Hills, Pretoria (ZA); Jacobus Daniël Adendorff, Hartbeespoort (ZA)

(73) Assignee: The South African Nuclear Energy Corporation (SOC) Ltd., Madibeng District (ZA)

( * ) Notice: Subject to any disclaimer, the term of this patent is extended or adjusted under 35 U.S.C. 154(b) by 0 days.

(21) Appl. No.: 16/080,540

(22) PCT Filed: Feb. 24, 2017

(86) PCT No.: PCT/IB2017/051058
§ 371 (c)(1),
(2) Date: Aug. 28, 2018

(87) PCT Pub. No.: WO2017/149417
PCT Pub. Date: Sep. 8, 2017

(65) Prior Publication Data

US 2019/0010680 A1 Jan. 10, 2019

(30) Foreign Application Priority Data

Feb. 29, 2016 (GB) ..... 1603473.8

(51) Int. Cl.
*E02F 9/26* (2006.01)
*E02F 9/28* (2006.01)
*G21H 5/02* (2006.01)

(52) U.S. Cl.
CPC ..... *E02F 9/264* (2013.01); *E02F 9/26* (2013.01); *E02F 9/2808* (2013.01); *G21H 5/02* (2013.01)

(58) Field of Classification Search
CPC ..... E02F 9/264; E02F 9/28–2891; G21H 5/02
(Continued)

(56) References Cited

U.S. PATENT DOCUMENTS 3,236,535 A * 2/1966 Barber ..... B66C 23/78 180/41
3,395,771 A * 8/1968 Swanson ..... A01B 69/00 180/401

(Continued)

FOREIGN PATENT DOCUMENTS

GB 2350831 A * 12/2000 ..... E02F 3/40
RU 2246764 C2 2/2005

(Continued)

OTHER PUBLICATIONS

PCT International Preliminary Report on Patentability in International Application No. PCT/IB2017/051058, dated Sep. 4, 2018, 8 pages.

(Continued)

*Primary Examiner* — Robert E Pezzuto
(74) *Attorney, Agent, or Firm* — Fish & Richardson P.C.

(57) ABSTRACT

A tagged excavation element, including an excavation element body and a tagging device securable to the excavation element body. The tagged excavation element is characterized in that the tagging device includes a man-made radioactive source. Typically, but not exclusively, the excavation element body comprises a shroud or tooth of an excavation bucket of a ground excavation tool (GET). A method is provided for manufacturing the tagged excavation element, and for detecting the tagged excavation element.

28 Claims, 2 Drawing Sheets

(58) Field of Classification Search
USPC ..... 37/446, 452–460; 172/701.1–701.3
See application file for complete search history.

(56) References Cited

U.S. PATENT DOCUMENTS 3,548,209 A * 12/1970 Smith ..... G21H 5/02 250/491.1
3,564,215 A * 2/1971 Peeples, Jr. ..... G06K 19/10 235/491
3,805,067 A * 4/1974 Wing ..... G21H 5/02 250/303
5,015,847 A * 5/1991 Rouillon ..... E02F 5/00 250/253
5,590,482 A * 1/1997 Peterson ..... E02F 3/404 141/108
5,743,031 A 4/1998 Launder et al.
10,280,585 B2 * 5/2019 Steff De Verninac ..... E02D 17/13
2012/0098654 A1 4/2012 Ebert
2014/0284503 A1 * 9/2014 Stevick ..... C22C 45/10 250/515.1
2015/0284935 A1 10/2015 Egger et al.
2017/0125213 A1 * 5/2017 Bauer ..... G21H 5/02

FOREIGN PATENT DOCUMENTS

WO WO 99/24812 5/1999
WO WO 2012/107848 8/2012

OTHER PUBLICATIONS

PCT International Search Report and Written Opinion in International Application No. PCT/IB2017/051058, dated May 29, 2017, 11 pages.
RU Office Action in Russian Application No. 2018133129/03, dated May 22, 2020, 15 pages (with English translation).

* cited by examiner

TAGGED EXCAVATION ELEMENT

CROSS-REFERENCE TO RELATED APPLICATIONS

This application is a National Stage application under 35 U.S.C. § 371 of International Application No. PCT/IB2017/051058, filed on Feb. 24, 2017, which claims the benefit of United Kingdom Application No. 1603473.8, filed on Feb. 29, 2016. The disclosures of the prior applications are incorporated by reference in their entirety.

BACKGROUND TO THE INVENTION

THIS invention relates to a tagged excavation element, and more particularly but not exclusively, to a tagged shroud or tooth of an excavation bucket. The invention also relates to a method of manufacturing a tagged excavation element, and to a method of detecting a tagged excavation element.

Many forms of excavation apparatuses and machines are known in the mining and construction industries, and in most embodiments they typically comprise some sort of ground engaging implement that is secured to a displaceable chassis or structure. An excavating bucket or scoop is but one type of ground engaging implement frequently encountered in industry, and is in the form of a partially enclosed receptacle having an open side through which a medium to be excavated can enter and exit the enclosed receptacle. The open side typically terminates in a cutting edge, with a plurality of spaced apart teeth, suitable for engaging and disrupting hard material, extending from the cutting edge The exposed sections of the cutting edge between the spaced apart teeth are covered by shrouds, which avoids wear and tear of the cutting edge, and hence the bucket body. The teeth and shrouds are therefore replaceable components that protect the actual body of the bucket or scoop against wear, in so doing extending the life of the body of the bucket or scoop. The lifespan of the shrouds and teeth vary from application to application, and a lifespan of 8 to 12 weeks is relatively common.

A problem frequently encountered in the mining environment, and in particular in open cast mining, is that the teeth and/or shrouds of excavator buckets or scoops break off during ore handling. The teeth and/or shrouds may then end up blocking or damaging a downstream crusher plant, with significant maintenance, cost and downtime implications. In addition, serious safety hazards accompany the removal of metal shrouds and teeth that are stuck in the crusher plant, as the stored mechanical energy can cause the shroud to shoot free and strike objects and persons in its path.

The problem is exacerbated by the fact that the environments in which the teeth and shrouds operate are associated with low visibility due to the presence of dust and other visual impediments. In addition, due to the nature of the operation, the teeth and shrouds are covered by ore for extended periods, reducing the effectiveness of visual inspection of the teeth and shrouds. The loss of a shroud is even less visible, due to the shrouds not standing proud from the cutting edge of the excavating bucket or scoop. Increased operator awareness and vigilance is therefore not a sufficient solution to this problem.

Several methods have been proposed to detect the loss of shovel teeth and shrouds, but existing methods have all failed to address the problem in a satisfactory manner. While the details differ, the common shortcoming is that the proposed methods are not robust enough to withstand the rigours of the earth-moving environment for as long as the shovel tips are in deployment (typically 8-12 weeks), or are not effective enough. In addition, detection equipment (for instance in RFID detection) cannot be placed in close enough proximity of the shrouds and teeth in order to be effective. Some solutions will furthermore generate a visual or audible cue when a tooth or shroud is lost, but it does not assist in locating the lost tooth or shroud because it merely indicates the loss of a tooth or shroud, without actually tagging said tooth or shroud.

It is accordingly an object of the invention to provide a tagged excavation element that will, at least partially, alleviate the above disadvantages.

It is a further object of the invention to provide a method and system for detecting a tagged excavation element.

It is also an object of the invention to provide a method of manufacturing a tagged excavation element.

SUMMARY OF THE INVENTION

According to the invention there is provided a tagged excavation element including:

an excavation element body; and a tagging device securable to the excavation element body;

characterized in that the tagging device includes a radioactive source.

There is provided for the tagging device to be in the form of a sealed radioactive source.

More particularly, the sealed radioactive source may comprise a radioactive material encapsulated in a sealed metal housing.

The tagging device, and more particularly the sealed metal housing, is preferably locatable inside an aperture provided in the excavation element.

There is further provided for the radioactive source to have a half-life of less than 150 days, preferably less than 120 days, more preferably less than 90 days.

There is also provided for the radioactive source to have a half-life of more than 40 days, preferably more than 60 days, more preferably more than 80 days.

In a preferred embodiment the radioactive source is a radioactive metal.

In a preferred embodiment the radioactive source emits gamma radiation at an energy level in excess of 300 keV, preferably more than 600 keV, more preferably more than 850 keV.

In a preferred embodiment the radioactive source emits gamma radiation at an energy level of less than 2000 keV, preferably less than 1700 keV, more preferably less than 1500 keV.

The radioactive source may be selected from the group including Scandium (Sc), Tantalum (Ta), Terbium (Tb) and Antimony (Sb).

In a preferred embodiment there is provided for the radioactive source to be a radioisotope of the element scandium (Sc), and more particularly to be the isotope Scandium 46 ($^{46}$Sc).

There is also provided for the radioactive source to be selected from the group of radioisotopes including Tantalum 182 ($^{182}$Ta), Terbium 160 ($^{160}$Tb) and Antimony 124 ($^{124}$Sb).

There is provided for the excavation element to be a shroud or a tooth of an excavation bucket.

According to a further aspect of the invention there is provided a method of manufacturing a tagged excavation element, the method including the steps of:

providing an excavation element;

providing a radioactive source; and securing the radioactive source to the excavation element.

There is provided for the tagging device to be in the form of a sealed radioactive source.

More particularly, the sealed radioactive source may comprise a radioactive material encapsulated in a sealed metal housing.

The tagging device is preferably locatable inside an aperture provided in the excavation element.

There is further provided for the radioactive source to have a half-life of less than 150 days, preferably less than 120 days, more preferably less than 90 days.

There is also provided for the radioactive source to have a half-life of more than 40 days, preferably more than 60 days, more preferably more than 80 days.

In a preferred embodiment the radioactive source is a radioactive metal.

In a preferred embodiment the radioactive source emits gamma radiation at an energy level in excess of 300 keV, preferably more than 600 keV, more preferably more than 850 keV.

In a preferred embodiment the radioactive source emits gamma radiation at an energy level of less than 2000 keV, preferably less than 1700 keV, more preferably less than 1500 keV.

The radioactive source may be selected from the group including Scandium (Sc), Tantalum (Ta), Terbium (Tb) and Antimony (Sb).

In a preferred embodiment there is provided for the radioactive source to be a radioisotope of the element scandium (Sc), and more particularly to be the isotope Scandium 46 ($^{46}$Sc).

There is also provided for the radioactive source to be selected from the group of radioisotopes including Tantalum 182 ($^{182}$Ta), Terbium 160 ($^{166}$Tb) and Antimony 124 ($^{124}$Sb).

There is provided for the excavation element to be a shroud or a tooth of an excavation bucket.

According to a still further aspect of the invention there is provided a method of detecting the displacement of an excavation element, the method including the steps of:

providing an excavation element tagged with a radioactive source;

providing a radiation detector; and detecting a change in radiation when the excavation element is displaced relative to the radiation detector.

The radiation detector may be mounted on part of the structure to which the excavation bucket is secured, and the radiation detector may detect a reduction in radioactivity when the excavation element is displaced away from the excavation bucket.

The structure may be the body of an excavation apparatus.

There is provided for one or multiple radiation detectors to be provided on an excavation apparatus.

The radiation detector may be mounted on a structure at one or more locations adjacent a route along which excavated material is displaced, and the radiation detector may detect an increase in radioactivity when the excavation element is displaced together with the excavated material.

The structure may be a gantry past which the excavated material is displaced.

The step of providing an excavation element tagged with a radioactive source may include the step of securing a sealed radioactive source to the excavation element.

There is provided for all the excavation elements secured to the excavation bucket to be tagged with radioactive sources.

According to a further aspect of the invention there is provided the use of a radioactive source in the detection of the displacement of an excavation element.

The radioactive source may be selected from the group including Scandium (Sc), Tantalum (Ta), Terbium (Tb) and Antimony (Sb).

In a preferred embodiment there is provided for the radioactive source to be a radioisotope of the element scandium (Sc), and more particularly to be the isotope Scandium 46 ($^{46}$Sc).

There is also provided for the radioactive source to be selected from the group of radioisotopes including Tantalum 182 ($^{182}$Ta), Terbium 160 ($^{160}$Tb) and Antimony 124 ($^{124}$Sb).

There is provided for the excavation element to be a shroud or a tooth of an excavation bucket.

According to a further aspect of the invention there is provided a sealed radiation source for use in a tagged excavation element.

BRIEF DESCRIPTION OF THE DRAWINGS

A preferred embodiment of the invention is described by way of a non-limiting example, and with reference to the accompanying drawings in which.

DETAILED DESCRIPTION OF INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

Figure 1:
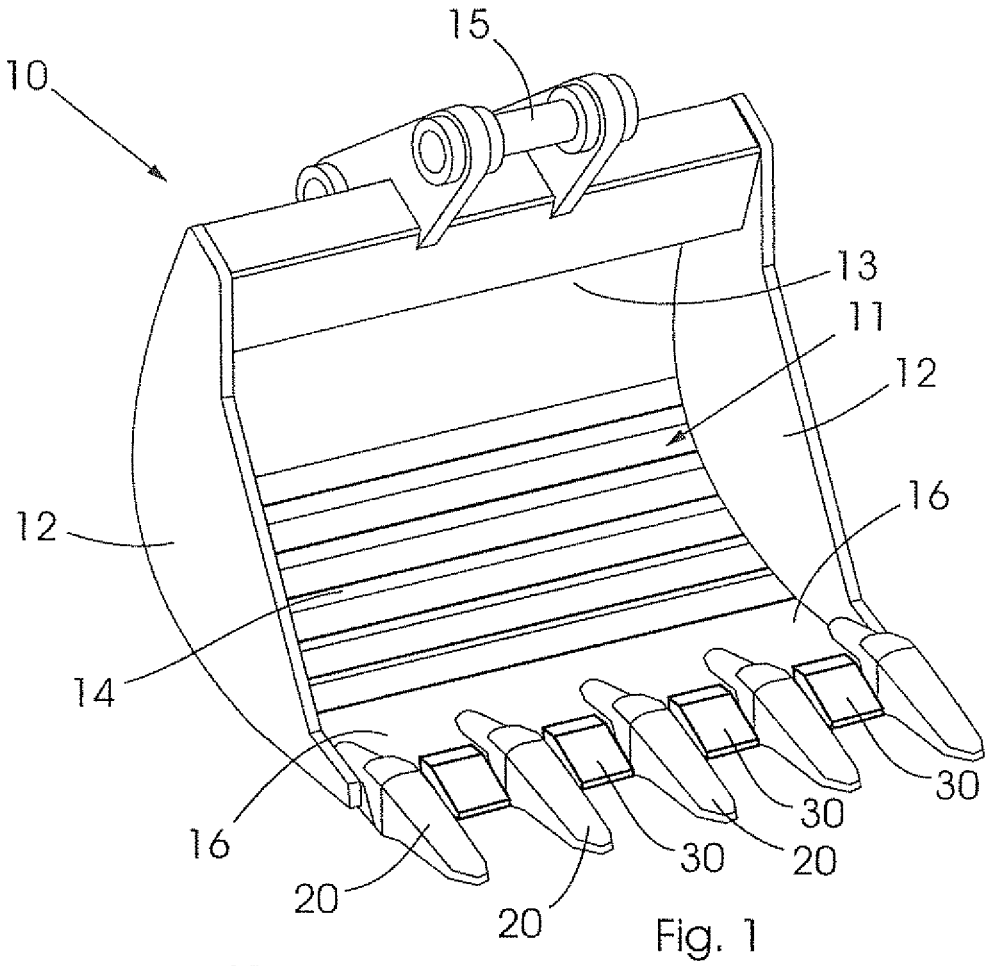
FIG. 1 is a perspective view of an excavation bucket of an excavation apparatus, with the excavation element being releasably secured to the excavation bucket.
Figure 2:
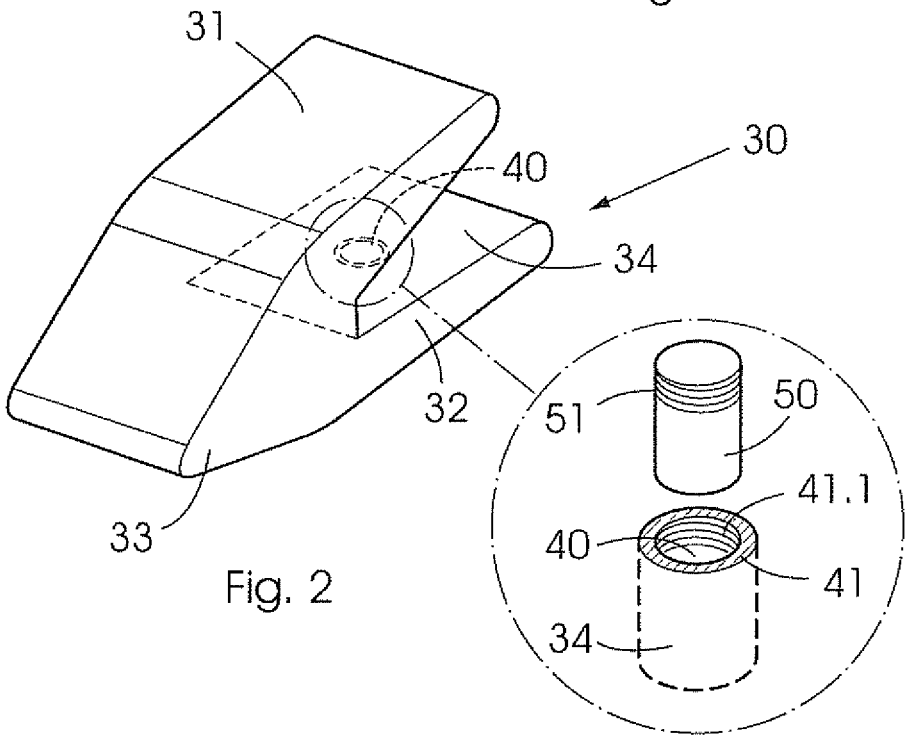
FIG. 2 is a schematic representation of an excavation element in accordance with one embodiment of the invention.

A non-limiting example of an excavation element in accordance with one embodiment of the invention is described with reference to FIGS. 1 and 2. From the outset, it should be noted that the excavation element 10 may form part of many different excavation or ground moving machines and/or apparatuses. The important aspect is that the excavation element is typically an object that will in use engage a medium to be excavated and/or displaced, and which will therefore undergo a substantial amount of mechanical wear. In this example, the excavation element is a shroud of an excavation bucket or scoop, which bucket or scoop is in turn part of an excavator or mechanical shovel. The same design and methodology could equally be applied to a tooth of the excavation bucket or scoop.

The excavator bucket 10 comprises a base 14, two opposing sidewalls extending transversely from opposing side edges of the base 14, and a rear wall 13 extending transversely from a rear edge of the base 14. The rear wall 13 extends between ends of the two sidewalls 12 so as to define a receptacle 11 suitable for receiving the material to be displaced. An operatively front end of the excavator bucket 10 terminates in a cutting edge 16, which also defines an open side of the receptacle 11 through which material to be displaced can enter or exit the receptacle 11.

A plurality of ground engaging teeth 20 protrude from the cutting edge 16, and are releasably secured to the cutting edge 16. The teeth 20 are spaced apart at regular intervals, and protective shrouds 30 are provided on the cutting edge 16 between the spaced apart teeth 20. The end of the base plate 14, which defines the cutting edge 16, is therefore not directly exposed to the material to be displaced, and is covered by the teeth 20 and shrouds 30. The teeth 20 and the shrouds 30 will wear over time, but these can then easily be replaced. It would be much more difficulty, expensive and time consuming to replace or repair the actual excavator bucket body, and the teeth 20 and shrouds 30 are therefore important components of the excavator bucket 10.

In accordance with one embodiment of the invention, a tagging device, in the form of a sealed source 50, is secured to the shroud 30 in order for the shroud to be detectable by a radiation detector (not shown). It should be noted that tagging devices may also be secured to the teeth 20 of the excavator bucket 10, but thus is less critical due to the teeth 20 being more visible due to the extent to which they protrude from the cutting edge 16. The probability of an operator noticing a missing tooth is therefore much higher than that off noticing a missing shroud.

The radioactive source will be housed in a sealed container 50, and may be secured to the shroud 30 (or another excavation element) in many different configurations. For example, an aperture 40 may be formed in a lower leg 32 of the shroud 30, and the source 50 may then fit inside the aperture. More particularly, the aperture may be formed (for example drilled or during casting or forging) into the upper surface of the lower leg 32 of the shroud 30, approximately 30 mm from the rear edge and approximately 20 mm deep. Inside the aperture will be secured an internally threaded 41.1 sleeve/cartridge 41, and the sealed source (a housing of which is complementary threaded 51) is then screwed into the sleeve. This will allow for easy installation and removal of the sealed source. Although it is foreseen that the sealed source will be located in the lower leg 32, it is also possible for the source to be located in the nose 33 or upper leg 31 of the shroud 30.

Figure 3:
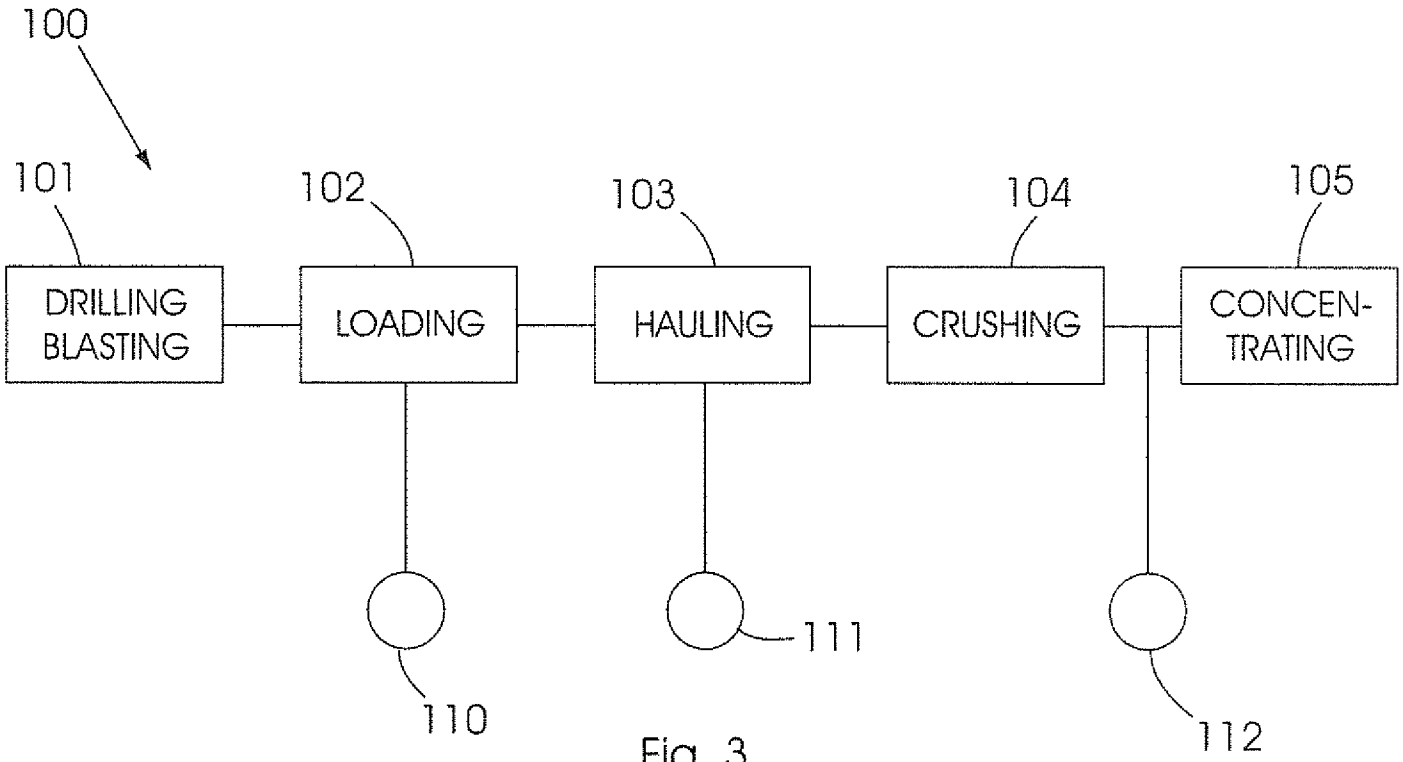
FIG. 3 is a schematic diagram showing monitoring points in a mining operation.

As shown in FIG. 3, it is foreseen that in one specific embodiment detection of the radioactive source will happen in at least three places and phases 110, 111 and 112 during the mining process 100. The primary objective is to the monitor the loss of excavation elements (e.g. teeth or shrouds) in-situ on the excavation apparatus in order for the operator to be aware of the loss of an excavation element before it is conveyed downstream towards the crushing plant 104. The first detection point 110 will therefore be on the excavation apparatus, and more particular on the excavation bucket 10, which is used to load ore 102 from the drilling/blasting site 101 into a hauling truck 103. The first detection point will therefore include a radiation detector which will constantly detect the radiation emitted by the source, and a stepped reduction in the radiation detected will imply the loss of at least one excavation element.

To mitigate potential failure in detecting the loss of a shroud, the haul truck 103 transporting the ore load to the crushing plant 104 may pass through a detection station 111 in the form of a gantry. A radiation detector will form part of the gantry, and any tagged shroud present in the ore load will be detected as a peak on the radiation monitor and the ore load can then be diverted and the tagged shroud manually located and removed. A compound failure to notice loss of a shroud, and subsequently to detect the radioactive source at the gantry 111, can possibly lead to the source being digested in the concentrator plant 105. A further detection or interception point 112 on the conveyor belt between crusher and concentrator plant can therefore be used to locate the source before it is altogether lost. The total solution therefore may consist of a 3-tier detection system, but it is also foreseen that detection may also occur in one or two places only The sealed radioactive source used in the tagging device has to meet a number of important operational, manufacturing and physical criteria. First of all, the half-life of the radioactive source must not be significantly longer than the operational life of the ground excavating element in order to reduce the impact of radioactive waste. At the same time, the half-life should also not be significantly shorter than the operational life of the ground excavating element, as the source will otherwise become weak and difficult to detect while the ground excavating element is still in use. Preferably, the half-life of the radioactive source should therefore be between about 80 and 100 days as this corresponds to the typical longevity of an excavation element body.

It is also preferable for the radioactive source to be in the form of a solid metal. The reason for this is that powders and non-metals cannot be formed into a welded metal-encapsulated sealed source, but will rather have to be quartzite-encapsulated. Quartzite encapsulation is not desirable for this particular application, because it is prone to shattering under mechanical stress, which in turn increases the potential for, and consequences of, radiological contamination.

A further requirement is that the radioactive source cannot be chemically product-identical or product-analogous, meaning that chemically it has to behave differently to the ore that is mined and found in the particular application. One can for example therefore not use a radioactive source which is a noble metal in a mine where noble metals are present, because there would then be a risk of the radioactive source nuclide ending up in the final product, which is obviously not desirable.

From a practical perspective, activation of the radioactive source must also be feasible. A radioactive source with a short activation period is preferable, because it reduces the extent to which unwanted nuclides breed. The spread of isotopes must also be favourable, for example in the sense that the spread should not include long-lived isotopes that will interfere with the decay profile of the source to create long term disposal problems, or isotopes with very high gamma energies that increase shielding requirements. For the purposes of this application, the simpler the decay profile, the better. For the purposes of this application, a seeding element that occurs mono-isotopically in nature, and can be bred to a single radio-active isotope through neutron or proton capture, or an element for which all radio-active byproducts are short-lived (half-life<1 day), is preferable.

Finally, due to the operational requirements (for example the fact that the ground engaging element may be located beneath a significant layer of ore), the radioactive source must exhibit ionizing radiation which is at the higher end of the energy spectrum—i.e. hard gammas are required. It is foreseen that hard gammas of at least 800 keV will be required, but ideally this should be even higher. An upper limit is expected to be about 1500 keV.

It is readily apparent that a vast number of diverse criteria will have to be met in order to find a suitable configuration within the criteria identified above. These include radiological, manufacturing and operational criteria as discussed above, and the proposed solution does not merely amount to the selection of an obvious radioactive source, but requires a multi-disciplinary approach straddling mining and metallurgical engineering, mechanical engineering and nuclear chemistry, far beyond routine experimentation. The complicated set of criteria has traditionally caused designers not to consider the use of a radioactive source for the particular application envisaged in this application, as the common assumption up to this point has been that the use of a radioactive source will simply not be feasible as a result of the number of diverse criteria to be met.

In a preferred embodiment, a radioisotope of the metallic element scandium, scandium-46 ($^{46}$Sc) having desired attributes in respect of half-life, gamma energy and simplicity of production, among others, is used as the radioactive source.

Scandium is present in most of the deposits of rare earth and uranium compounds, but it is extracted from these ores in only a few mines worldwide. Because of the low availability and the difficulties in the preparation of metallic scandium it took until the 1970s before applications for scandium were developed. The positive effects of scandium on aluminium alloys were discovered in the 1970s, and its use in such alloys remains one of its major applications. In addition, scandium is also used in small quantities in the manufacture of high intensity lighting. The global trade of the pure metal is around fifty kilograms per year on average, and it is therefore clear that scandium is not a common element, and indeed an element with very limited application in trade and industry. The same applies to scandium's most stable radioisotope, scandium-46. The properties of Scandium-46 render it unsuitable for most applications where a radioisotope is required. In particular, the relatively short half-life makes it generally unsuitable for use in sealed radioactive source applications, such as far example medical uses, non-medical irradiation of products, gauging systems, non-destructive testing applications and material analyses.

The radioisotope scandium-46 ($^{46}$Sc) is a metal, has a half-life of 84 days and is not chemically related to platinum group metals (PGM's) or other noble metals. It is furthermore easy to produce scandium-46 through activation of scandium-45 (occurring mono-isotopically in nature) via neutron capture, requiring a small fraction of neutron flux exposure in comparison to several other potential candidate isotopes. Only one isotope with a very clean spectrum is produced, resulting in a relatively low presence of undesired activity. The gammas are 890 and 1121 keV, respectively, which also meets the requirements as set out above.

It is envisaged that about 1-5 millicurie ($3.7–18.5\times10^7$ Bq) of scandium-46 activity will be used for each individual sealed source.

A number of radioactive isotopes appear to be suitable for this application when only considering the half-life of radioactive isotopes. However, most of them may not be a feasible selection due to the remaining requirements not being met. For example, some isotopes may not be preferable for use as a radioactive tag for an excavation element, due to current impractical production routes, which include:

| Nuclide | Half-life (days) | Reason why this would not work |
|---|---|---|
| Mendelevium-258 | 51.5 | No practical production route. |
| Cobalt-56 | 77.27 | Cannot be produced via neutron capture. Other pathways are very complicated requiring non-stable intermediates. |
| Cobalt-58 | 70.86 | Cannot be produced via neutron capture. Other pathways are very complicated requiring non-stable intermediates. |
| Thulium-168 | 93.1 | Cannot be produced via neutron capture. Other pathways are very complicated requiring non-stable intermediates. |

The best, but not ideal, alternatives to Sc-46 are: Ta-182, Tb-160, Zr-95, Sb-124, Fe-59 and Y-91, and the following table summarizes the relevant properties of each:

| Nuclide | Half-life (days) | Gamma (keV) | Precursor | Metal Y/N | Ease of Activation | Chemical Affinity |
|---|---|---|---|---|---|---|
| Sc-46 | 84 | 890; 1121 | Sc-45 | Y | Easy | Non-noble |
| Ta-182 | 115 | 1122 | Ta-181 | Y | Easy | Non-noble |
| Tb-160 | 72 | 879 | Tb-159 | Y | Easy | Non-noble |
| Zr-95 | 65 | 724 | Zr-94* | Y | Difficult | Non-noble |
| Sb-124 | 60 | 1692 | Sb-123** | Y | Medium | Non-noble |
| Fe-59 | 45 | 1292 | Fe-58*** | Y | Difficult | Non-noble |
| Y-91 | 59 | 1210 | Y-89, Y-90 | Y | Difficult | Non-noble |

*Natural Zr has 4 isotopes. Zr-92 can breed to Zr-93, which is a long-lived (half-life = 1.5 million years) beta emitter, however, the very low neutron absorption cross section of Zr may probably make it impractical to manufacture.
**Natural Sb has 2 isotopes. Sb-121 can breed to Sb-122 (half-life = 2.7 d), which may necessitate a prolonged cooling down period. Over-breeding to Sb-125 (half-life = 2.8 years) can lead to long term disposal problems.
***Natural Fe has 4 isotopes. Fe-54 can breed to Fe-55, a medium-long-lived (half-life = 2.7 years) beta emitter.
Y-91 cannot be made through direct neutron capture, and a compound process will be required.

The inventor is of the view that the use of a sealed radioactive source to tag a ground engaging element will provide a new and useful solution to the problem of detecting and monitoring ground engaging elements forming part of earth moving/displacement machinery. The use of scandium-46 as the radioactive isotope will be particularly beneficial in that it meets all the diverse requirements of this particular application.

The sealed radioactive source will be reliable, and will be easily detectable. At the same time the radiation risk is very low due to the selection criteria proposed, and the problems usually associated with nuclear waste will also be negated by the short half-life of the selected isotope.

It will be appreciated that the above is only one embodiment of the invention and that there may be many variations without departing from the spirit and/or the scope of the invention.

The invention claimed is:

1. A tagged excavation element including:

an excavation element body; and a tagging device securable to the excavation element body;

characterized in that the tagging device includes a radioactive source, wherein the excavation element is a shroud or a tooth of an excavation bucket.

2. The tagged excavation element of claim 1 in which the tagging device is in the form of a sealed radioactive source.

3. The tagged excavation element of claim 2 in which the sealed radioactive source comprises a radioactive material encapsulated in a sealed metal housing.

4. The tagged excavation element of claim 3 in which the sealed metal housing is locatable inside an aperture provided in the excavation element.

5. The tagged excavation element of claim 1 in which the radioactive source has a half-life of between 40 days and 150 days.

6. The tagged excavation element of claim 5 in which the radioactive source has a half-life of between 80 days and 90 days.

7. The tagged excavation element of claim 1 in which the radioactive source is a radioactive metal.

8. The tagged excavation element of claim 1 in which the radioactive source emits gamma radiation at an energy level between 300 keV and 2000 keV.

9. The tagged excavation element of claim 8 in which the radioactive source emits gamma radiation at an energy level between 850 keV and 1500 keV.

10. The tagged excavation element of any one of the preceding claims in which the radioactive source is selected from the group including scandium (Sc), tantalum (Ta), terbium (Tb) and antimony (Sb).

11. The tagged excavation element of any one claims 1 to 9 in which the radioactive source is a radioisotope of the element scandium (Sc), scandium 46 ($^{46}$Sc).

12. A method of manufacturing a tagged excavation element, the method including the steps of:

providing an excavation element body;

providing a tagging device including a radioactive source; and securing the tagging device to the excavation element body, wherein the excavation element is a shroud or a tooth of an excavation bucket.

13. The method of claim 12 in which the tagging device is in the form of a sealed radioactive source.

14. The method of claim 13 in which the sealed radioactive source comprises a radioactive material encapsulated in a sealed metal housing.

15. The method of claim 14 in which the sealed metal housing is locatable inside an aperture provided in the excavation element.

16. The method of claim 12 in which the radioactive source has a half-life of between 40 days and 150 days.

17. The method of claim 16 in which the radioactive source has a half-life of between 80 days and 90 days.

18. The method of claim 12 in which the radioactive source is a radioactive metal.

19. The method of claim 12 in which the radioactive source emits gamma radiation at an energy level between 300 keV and 2000 keV.

20. The method of claim 19 in which the radioactive source emits gamma radiation at an energy level between 850 keV and 1500 keV.

21. The method of any one of claims 12 to 20 in which the radioactive source is selected from the group including scandium (Sc), tantalum (Ta), terbium (Tb) and antimony (Sb).

22. The method of any one of claims 12 to 20 in which the radioactive source is a radioisotope of the element scandium (Sc), scandium 46 ($^{46}$Sc).

23. A method of detecting the displacement of an excavation element, the method including the steps of:

providing an excavation element tagged with a tagging device including a radioactive source, the excavation element comprising a shroud or a tooth of an excavation bucket;

providing a radiation detector; and detecting a change in radiation when the excavation element is displaced relative to the radiation detector.

24. The method of claim 23 in which the radiation detector is mounted on part of a structure to which the excavation element is secured, and in which the radiation detector detects a reduction in radioactivity when the excavation element is displaced away from the structure.

25. The method of claim 24 in which the structure is the body of an excavation apparatus.

26. The method of claim 25 in which one or multiple radiation detectors are provided on the excavation apparatus.

27. The method of 25 in which the radiation detector is mounted on a structure at one or more locations adjacent a route along which excavated material is displaced, and in which the radiation detector detects an increase in radioactivity when the excavation element is displaced together with the excavated material.

28. The method of claim 27 in which the structure is a gantry past which the excavated material is displaced.

* * * * *